United States Patent [19]

Matthias et al.

[11] 4,413,920

[45] Nov. 8, 1983

[54] PRINTING RIBBON CARTRIDGE WITH FLEXIBLE RIBBON GUIDES

[75] Inventors: Dan W. Matthias, Downingtown; Collier M. Miller, Rosemont, both of Pa.

[73] Assignee: Exxon Research and Engineering Co., Florham Park, N.J.

[21] Appl. No.: 310,158

[22] Filed: Oct. 9, 1981

Related U.S. Application Data

[63] Continuation of Ser. No. 98,773, Nov. 30, 1979, abandoned, which is a continuation of Ser. No. 833,257, Sep. 14, 1977, abandoned.

[51] Int. Cl.[3] ..... B41J 35/04

[52] U.S. Cl. ..... 400/248; 400/208; 400/228; 400/234

[58] Field of Search ..... 400/196.1, 207, 208, 400/208.1, 216, 228, 229, 234, 235.1, 248; 242/55, 192, 199, 206; 310/103; 271/2.3; 33/137 R, 138

[56] References Cited

U.S. PATENT DOCUMENTS

| | | | |
|---|---|---|---|
| 1,402,589 | 1/1922 | Farrand | 33/138 |
| 1,862,267 | 3/1927 | Honig | 310/103 |
| 1,962,659 | 12/1930 | Kautz | 310/103 |
| 1,964,248 | 6/1934 | Buck et al. | 33/137 R |
| 1,964,280 | 6/1934 | Witchger | 33/138 |
| 1,973,843 | 9/1934 | Buck | 33/137 R |
| 1,992,947 | 3/1935 | Hayward | 33/138 |
| 2,048,754 | 8/1932 | Putnam | 271/2.3 |
| 2,052,259 | 8/1936 | Stowell | 33/138 |
| 2,063,285 | 4/1934 | Wittel | 242/199 |
| 2,127,812 | 12/1936 | Gabrielson | 400/228 |
| 2,444,797 | 1/1947 | Williams | 310/103 |
| 2,746,691 | 12/1951 | Hoad | 242/55 |
| 2,956,795 | 10/1960 | Foster | 33/138 |
| 2,986,260 | 12/1957 | Whippo | 400/208 |
| 3,047,121 | 1/1958 | Roggenstein | 400/207 X |
| 3,205,997 | 9/1962 | Przybylowicz | 400/235.1 X |
| 3,272,304 | 9/1966 | Morelli | 400/208.1 |
| 3,349,887 | 10/1967 | Goff | 400/208 |
| 3,356,202 | 12/1967 | Goff | 400/208 |
| 3,409,113 | 11/1968 | McLean | 400/234 X |
| 3,692,255 | 6/1971 | von Behren | 242/192 |
| 3,724,780 | 7/1971 | Wolf | 242/206 |
| 3,850,358 | 11/1974 | Nettles | 400/208 X |
| 3,905,465 | 9/1975 | Frechette et al. | 400/208 X |
| 3,994,383 | 11/1976 | Best | 400/196.1 |
| 4,047,607 | 9/1977 | Willcox | 400/208 |
| 4,047,608 | 9/1977 | Willcox | 400/208 |
| 4,058,197 | 11/1977 | West | 400/229 X |

FOREIGN PATENT DOCUMENTS

| | | | |
|---|---|---|---|
| 2019648 | 11/1971 | Fed. Rep. of Germany | 400/248 |

*Primary Examiner*—Ernest T. Wright, Jr.

[57] ABSTRACT

A ribbon cartridge in a movable print point printer remains stationary while the ribbon moves to and from the print point along a path of fixed length. The path length is established by a first flexible leader which extends from the cartridge to the print point and a second flexible leader which extends from the print point back to the cartridge. The cartridge includes a supply reel for storing ribbon before the ribbon advances to the movable print point and a take-up reel for storing ribbon after it returns from the movable print point. The flexible leader comprises a steel member having a transverse curvature for preventing the leaders from assuming a reverse curvature and maintaining a curvature of substantially constant radius.

28 Claims, 16 Drawing Figures

PRINTING RIBBON CARTRIDGE WITH FLEXIBLE RIBBON GUIDES

This is a continuation of Ser. No. 98,773, filed Nov. 30, 1979, now abandoned, which was a continuation of Ser. No. 833,257, filed Sept. 14, 1977, now abandoned.

BACKGROUND OF THE INVENTION

This invention relates to impact printers and, more particularly, to impact printers wherein a ribbon moves between a ribbon storage area and a print point to continuously supply fresh ribbon to a position between a character element and a print receiving medium.

In printers of this type including typewriters, the ribbon storage has been provided by a cartridge. These cartridges are removable so as to permit the ribbon supply to be replenished by merely replacing the ribbon cartridge.

In various printers including typewriters such as those manufactured by IBM and SCM, the platen which supports the print receiving medium in the impact printing position remains stationary and the character printing elements move along the platen to the various printing positions. In these printers the cartridge has been mounted for movement with the character elements and the print point so as to continuously supply fresh ribbon to the print point as the character elements advance. Typically, the cartridge has been supported on a carriage which moves linearly along the platen where the character elements may be mounted on a ball or wheel oftentimes referred to as a daisy. Where the printer is to operate at high speeds as in the case of a typewriter operating in an automatic memory mode, the carriage must be capable of very high acceleration and deceleration rates which places a substantial demand on the motors, drivers and power supplies for the carriage. Where the carriage also accelerates and decelerates the ribbon cartridge which is mounted on the cartridge, the demands on the carriage motor, driver and power supply can become very substantial.

In order to minimize these demands, ribbon cartridges which are mounted on the cartridge have had a limited ribbon capacity. Although this has achieved the objective of limiting the weight which must be accelerated and decelerated as the carriage and the print point move, there have been certain, significant penalties. First, the cartridge must be changed more frequently where the ribbon capacity is small. This is of course time-consuming for the operator of the printer or typewriter and also presents some risk that the print receiving medium may be in some way defaced by removing and replacing the cartridge, e.g., smearing is not at all uncommon in such circumstances. Second, the smaller ribbon cartridges include a rather complex mechanism which is quite costly when one considers that the cartridge is in effect disposable. Where the ribbon capacity is quite limited, the cost of the mechanism relative to the ribbon of the cartridge becomes quite substantial and the overall cost of the cartridge per strike becomes high.

As described in copending application Ser. No. 833,270 filed Sept. 14, 1977 in the name of Dan W. Matthais, assigned to the assignee of this invention, these difficulties of the prior art have been overcome by providing a laterally movable character printing means such as a print which is juxtaposed to a support means such as a platen or a print receiving medium such as paper in combination with a stationary storage means for a ribbon carrying a printing medium where the ribbon is advanced past the movable print point in printing relationship with the print receiving medium while maintaining a substantially constant ribbon path length from the stationary ribbon storage means to the movable print point.

In a preferred embodiment of the aforesaid invention, the substantially constant ribbon path length is achieved by means of a first flexible leader which extends from the ribbon storage means to the print point and a second flexible leader which extends from the print point to the storage means. The ribbon is supported by and moves along these flexible leaders.

However, such flexible leaders tend to disturb the printing medium, i.e., the ink, of the ribbon as the ribbon moves therethrough. This is particularly true where the flexible leaders assume compound or reverse curvature so that the side of the ribbon bearing the ink or printing medium necessarily rubs against the flexible leader when the tension is applied to the ribbon and a portion of the surface of the ribbon carrying the ink contacts the surface of the leader due to the compound or reverse curvature. Where the printing medium or ink is of the correctible or lift-off type, the ink may be easily disturbed so as to impair the printing operation. Furthermore, the flexible leaders may be unruly and produce irregular curvatures which interfere with the operation of the printer components.

SUMMARY OF THE INVENTION

It is an object of this invention to assure that flexible leaders associated with a ribbon storage means do not adversely affect the printing medium on the ribbon.

It is a further object of this invention to assure that such flexible leaders do not in any way interfere with other components of a printer utilizing such a ribbon storage means.

In a preferred embodiment of the invention, the printer comprises means adapted to support a print receiving medium, laterally movable character printing means juxtaposed to said support means for establishing a laterally movable print point and a ribbon comprising a printing medium adapted to advance past the movable print point in printing relationship with the print receiving medium and the character means. A stationary ribbon storage means stores the ribbon before and after the ribbon is moved past the print point.

In accordance with one important aspect of the invention, the ribbon is supported in its path with movement to and from the print point by flexible leader means which maintains the curvature in a single direction as the print point moves.

In accordance with another important aspect of the invention, the flexible leader means maintains a substantially constant radius of curvature as the print point moves and the leader bends although the position of the curvature on the leader may move.

In the preferred embodiment of the invention, the leader means maintains a curvature in a concave direction with respect to the print point with the inked side of the ribbon facing generally toward the print point at the print point and the uninked side facing generally outwardly away from the print point.

In accordance with one important aspect of the invention, the flexible leader is characterized by a radius of curvature transverse to the length of the leader in a substantially straight line segment of the leader. The transverse curvature is convex with respect to the center of curvature of the leader which tends to travel along the length of the leader as the print point moves.

In accordance with another important aspect of the invention, the leader comprises a steel portion with a flexible cover extending across and along the steel portion and movable relative thereto. The cover forms a channel for guiding the ribbon such that the inked side is always spaced from the cover and the uninked side is in contact with the steel portion on the inside of the radius of curvature of the leader. The steel portion resembles a carpenter's rule and provides the transverse curvature which is characterized by a first beam when the leader is substantially straight and a second beam when the leader has the substantially constant radius of curvature.

DETAILED DESCRIPTION OF A PREFERRED EMBODIMENT

Figure 1:
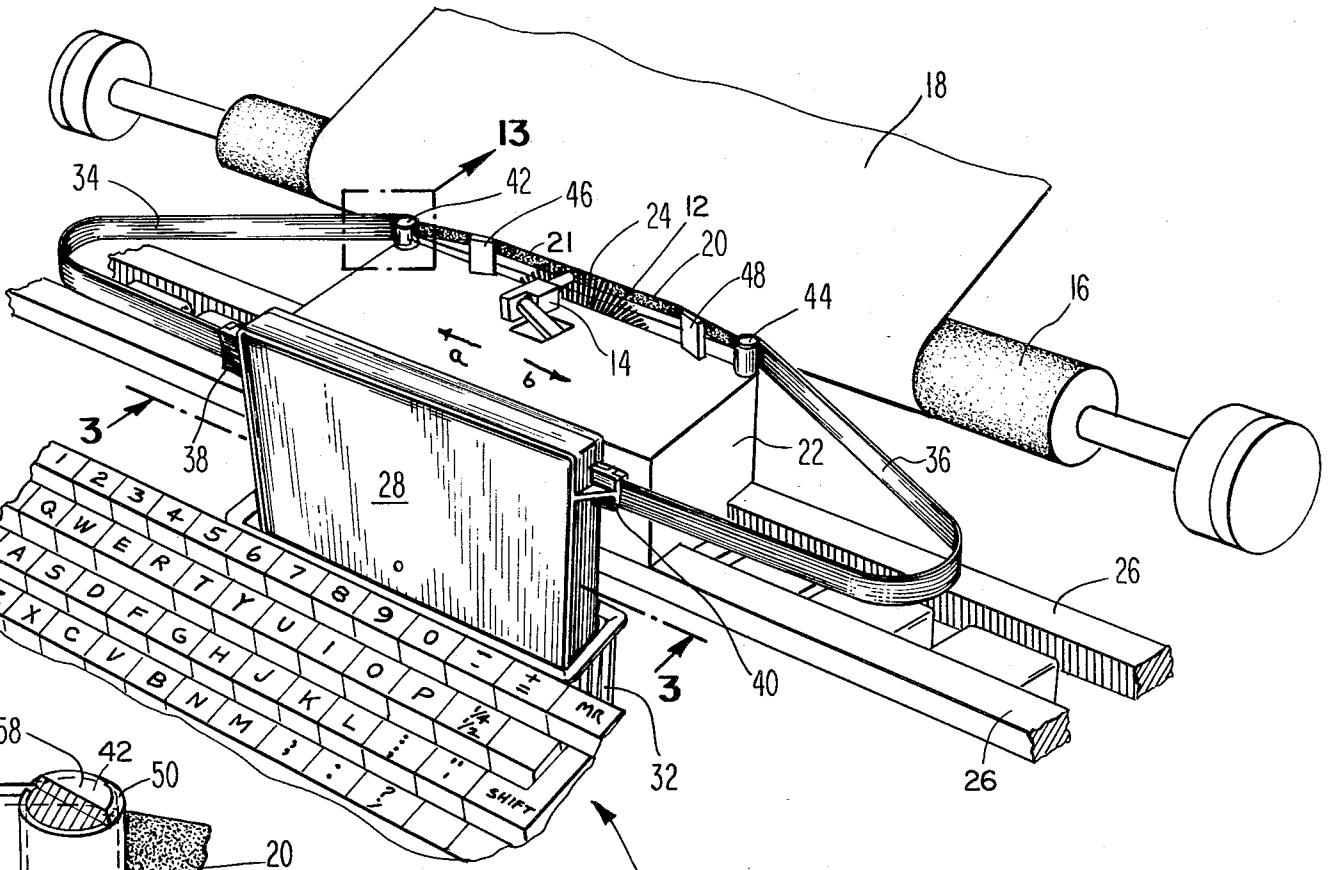
FIG. 1 is a perspective view of a typewriter embodying the invention.

A printer comprising a typewriter shown in FIG. 1 includes a keyboard 10 having a multiplicity of keys corresponding to various characters which, upon depression, control the position of a rotatable character array in the form of a print wheel 12 juxtaposed between impact means in the form of a hammer 14 and a platen 16. The platen 16 is adapted to support a print receiving medium in the form of paper 18 which is contacted by the marking medium in the form of an ink ribbon 20 having an uninked side 21 and an inked side 65 (FIG. 3) which is located between the print wheel 12 and the paper 18 so as to leave a mark in ink corresponding to the particular character of the print wheel 12 which is in position between the hammer 14 and the paper 18.

As shown in FIG. 1, the print wheel 12 and the hammer 14 are mounted on a carriage 22 which is adapted to move in a lateral direction parallel with the surface of the platen 16 so as to position the print wheel 12 at various positions along the paper 18 in response to the depression keys on the keyboard 10. As the carriage 22 is moved, the print wheel 12 rotates so as to position the proper character element at the end of a radially extending spoke 24 in a printing position aligned with the print hammer 14. The lateral movement of the carriage 22 along the support surfaces 26 may be achieved by various means known in the art including a linear stepper motor such as that shown in copending application Ser. No. 809,646 filed June 24, 1977 in the name of Dan W. Matthias and Richard D. Thornton, now U.S. Pat. No. 4,198,582 issued Apr. 15, 1980, assigned to the assignee of this invention.

Figure 2:
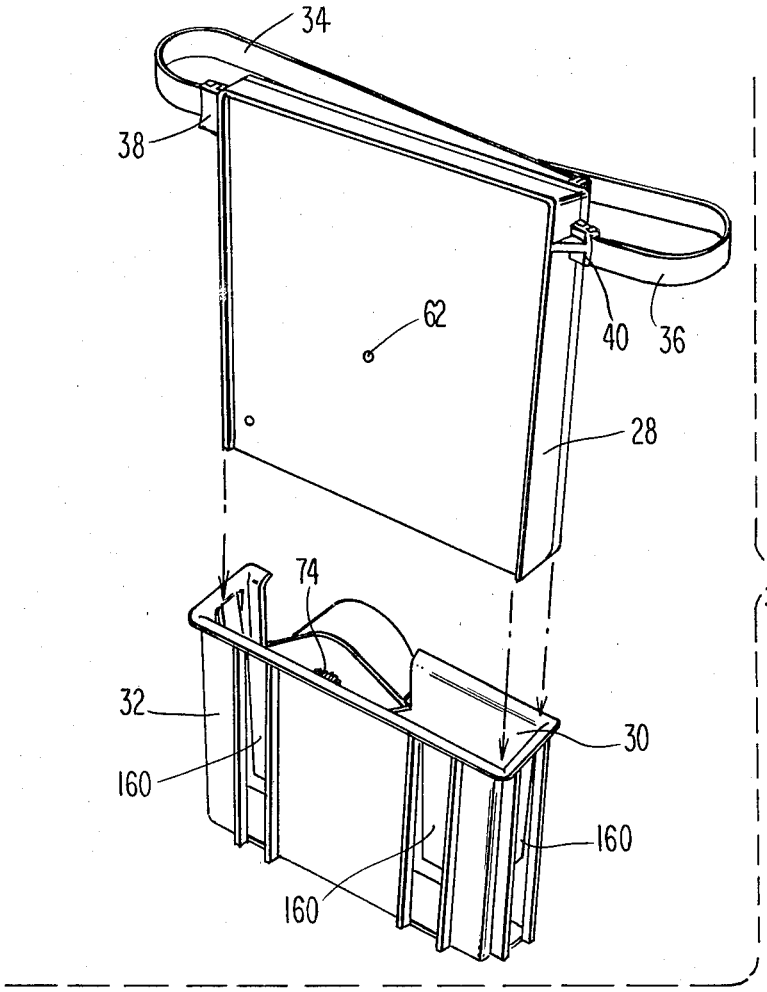
FIG. 2 is an exploded perspective view of the cartridge and the cartridge holder shown in FIG. 1.

In accordance with the aforesaid copending application Ser. No. 833,270 assigned to the assignee of this invention, the ribbon 20 is stored within a stationary cartridge 28 which is received, as best shown in FIG. 2, by a pocket 30 in an integrally molded receptacle 32. As shown in FIG. 1, the ribbon path length between the print point as determined by the position of the carriage 22 and the cartridge 28 is maintained constant over a substantial portion thereof by a first flexible leader 34 which extends from the cartridge 28 to the carriage 22 and a second flexible leader 36 which extends from the carriage 22 to the cartridge 28.

The leaders 34 and 36 which are constructed in accordance with this invention to be described hereinafter are secured to the cartridge 28 by mounting brackets 38 and 40. At the carriage 22, the free ends of the leaders 34 and 36 are fastened to carriage posts 42 and 44. The ribbon 20 is then exposed as it spans the gap between the posts 42 and 44 which includes guides 46 and 48. It will be understood that the distance from the post 42 to the print point remains constant as does the distance from the print point to the post 44.

Figure 11:
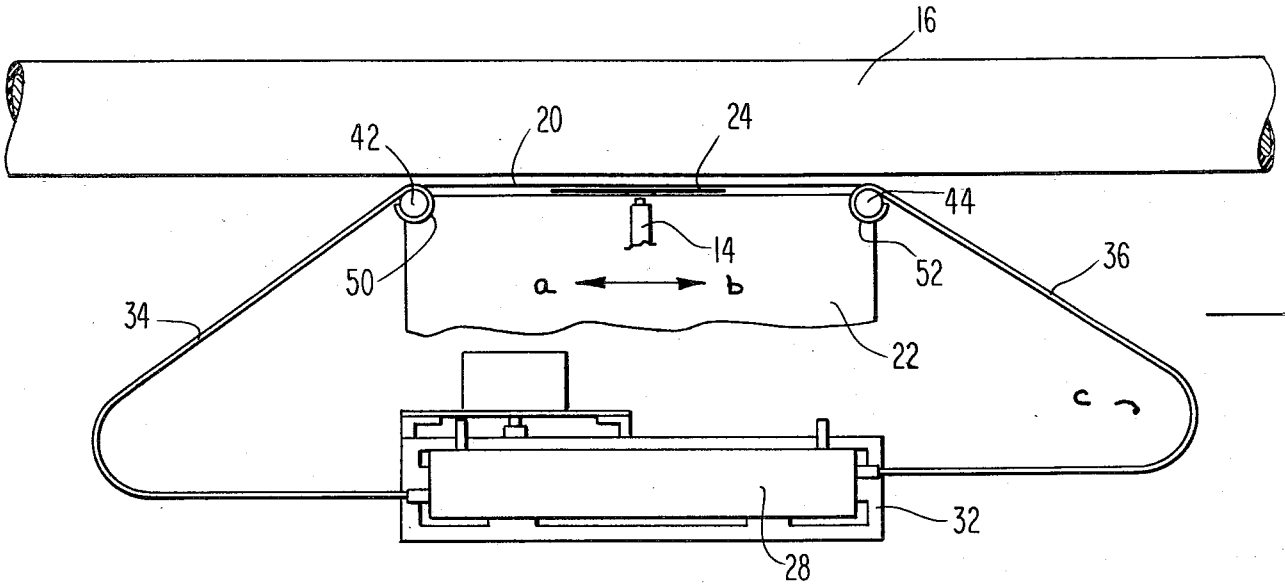
FIG. 11 is a plan view of the typewriter shown in FIG. 1 with the print point centrally located with respect to the platen.
Figure 12:
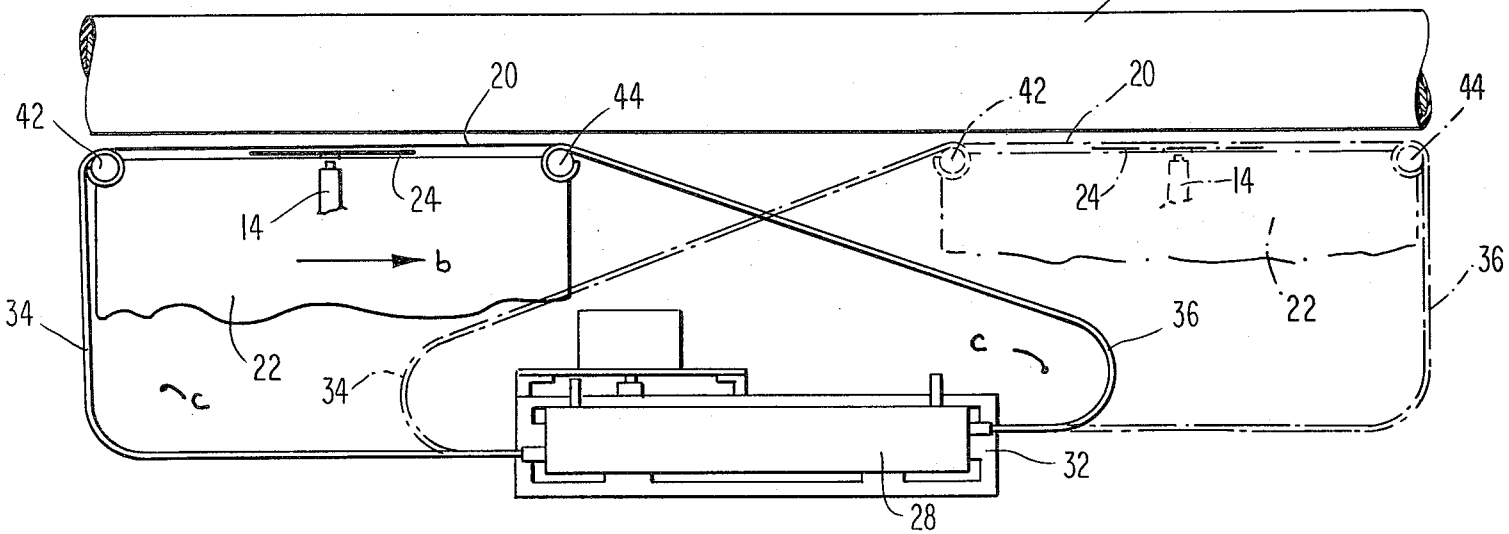
FIG. 12 is a plan view of the typewriter shown in FIG. 1 showing the print point at different locations along the platen.

By providing a constant ribbon path length between the stationary cartridge 28 and the movable print point as shown in FIG. 1, the ribbon 20 may be continuously advanced as printing proceeds without any necessity for reversing the ribbon 20 as the print point moves in different directions a and b thereby assuring a fresh segment of ribbon 20 for the print point where the segment is guided by the leaders 34 and 36. In this regard, reference is made to FIGS. 11 and 12 wherein various print point positions relative to the stationary cartridge 28 are shown. In FIG. 11, the carriage 22 is substantially centered on the platen 16 and the overall ribbon path length from the cartridge 28 along the leader 34 to the print point at the hammer 14 is substantially equal to the overall path length from the print point along the leader 36 to the cartridge 28. In FIG. 12, the carriage 22 as shown in full is moved to the far left of the platen 16 while ribbon path lengths to the print point along the leader 34 and the leader 36 remain equal even though the leaders 34 and 36 have substantially different configurations. When the carriage 22 is advanced in a direction indicated by the arrow b to a position shown in phantom, the overall ribbon path lengths along the leaders 34 and 36 remain the same although the configurations of the leaders 34 and 36 of necessity change.

As clearly shown in FIGS. 1, 11 and 12, the flexible leaders 34 and 36 do not extend the full ribbon path length to the print point. Rather, the ribbon 20 is pulled taut between posts 42 and 44 past the print point at the hammer 14 without any support by the leaders 34 and 36. However, since the position of the print point with respect to the posts 42 and 44 remains constant and the overall length of the leaders 34 and 36 remains constant, the overall ribbon path length between the cartridge 28 and the movable print point remains constant.

Figure 13:
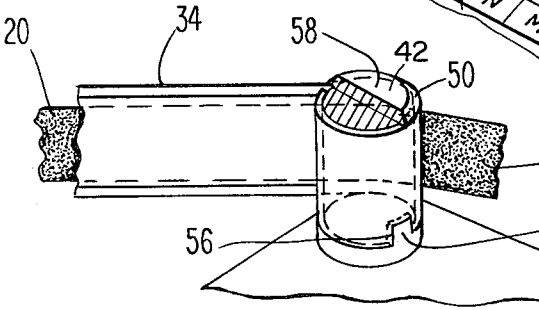
FIG. 13 is an enlarged view of a portion of the typewriter identified in FIG. 1 with the reference character 13.

In order to maintain the overall ribbon path length constant, it is important that the flexible leaders 34 and 36 which include loops 50 and 52 which are wrapped around the posts 42 and 44 respectively do not rotate on the posts 42 and 44. Elimination of any rotation as the carriage 22 moves is accomplished by means of keying the loops 50 and 52 to the posts 42 and 44 as shown in FIG. 13. In this connection, a keying projection 54 at the base of post 42 is received by a notch 56 in the loop 50. A similar keying projection on the post 44 is provided which cooperates with a similar notch on the loop 52. The posts 42 and 44 may also be provided with a slight head 58 which serves to hold the flexible leaders 34 and 36 down on the posts 42 and 44 once the leader 34, 36 is snapped in place.

Figure 3:
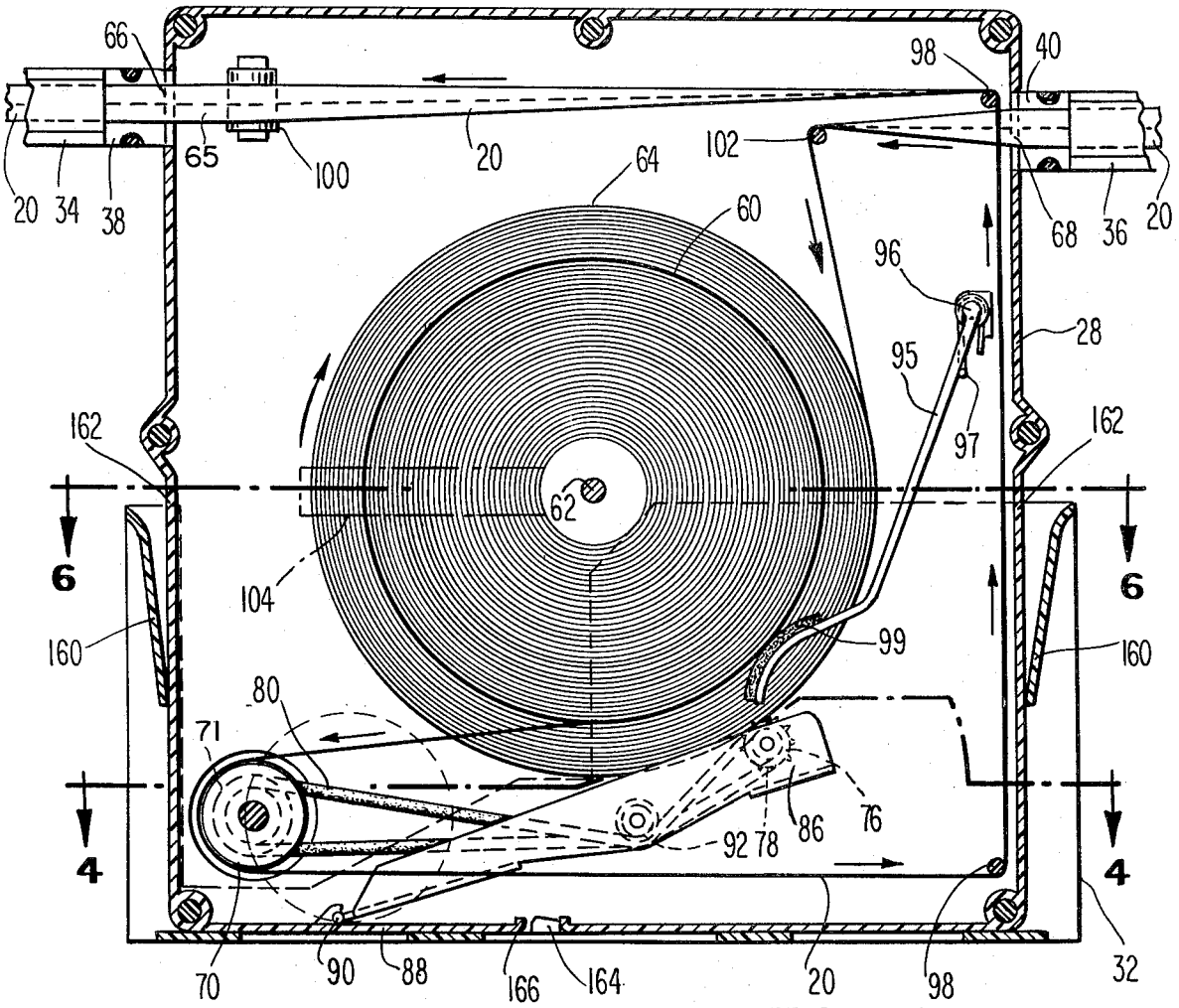
FIG. 3 is a sectional view taken along line 3—3 of the cartridge shown in FIG. 1.

Reference will now be made to FIGS. 3–6 for a description of the manner in which the ribbon 20 is stored within the cartridge 28. As best understood with reference to FIG. 6, the cartridge 28 comprises a supply reel 60 which is mounted on a common axis 62 with a take-up reel 64. Referring to FIG. 3, the ribbon 20 having an inked side 65 moves from the supply reel 60 through the interior of the cartridge 28 to an outlet 66 at the bracket 38 mounting the leader 34. The ribbon 20 then moves to the movable print point at the hammer 14 along a fixed path length including the leader 34 and returns to the cartridge 28 along the return fixed path length established in part by the leader 36 which is mounted on the bracket 40 at the inlet 68 of the cartridge 28. From the inlet 68, the ribbon 20 is returned along the path indicated by the arrows to the take-up reel 64.

In accordance with the invention of copending application Ser. No. 833,269 filed Sept. 14, 1977 in the names of Collier M. Miller and Michael J. Rello and assigned to the assignee of this invention, now abandoned, drive means is associated with the supply reel 60 so as to meter the ribbon 20 out from supply reel 60 and a take-up drive means is associated with the take-up reel 64 so as to continuously supply a fresh segment of ribbon 20 to the print point. Tension control means associated with the metering drive means and the take-up drive means control the drive of the take-up drive means relative to the metering drive means thereby controlling tension on the ribbon 20 as it passes flexible leaders 34 and 36 so as to control the friction encountered by the ribbon 20 as it moves to and from the movable print point along the fixed path length.

Figure 6:
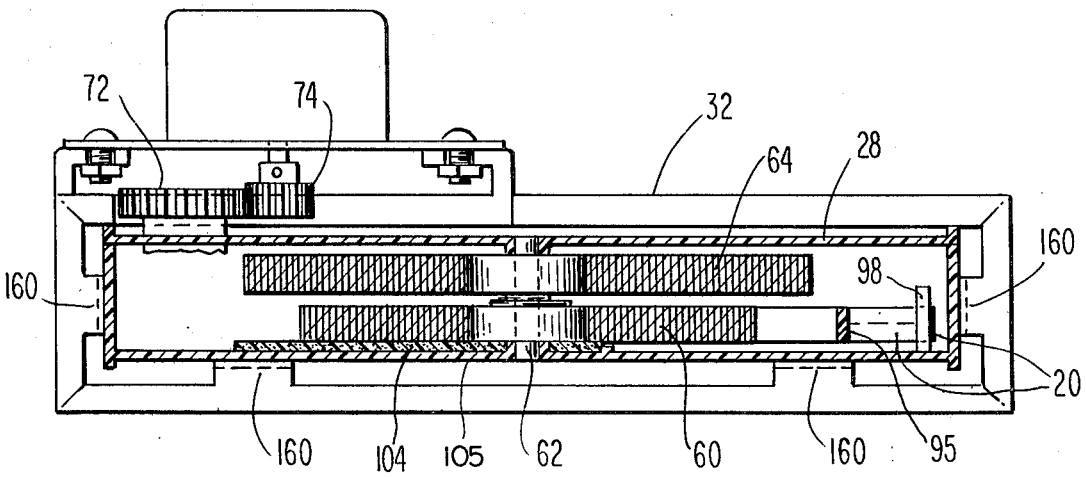
FIG. 6 is a sectional view of the cartridge shown in FIG. 3 taken along line 6—6.
Figure 4:
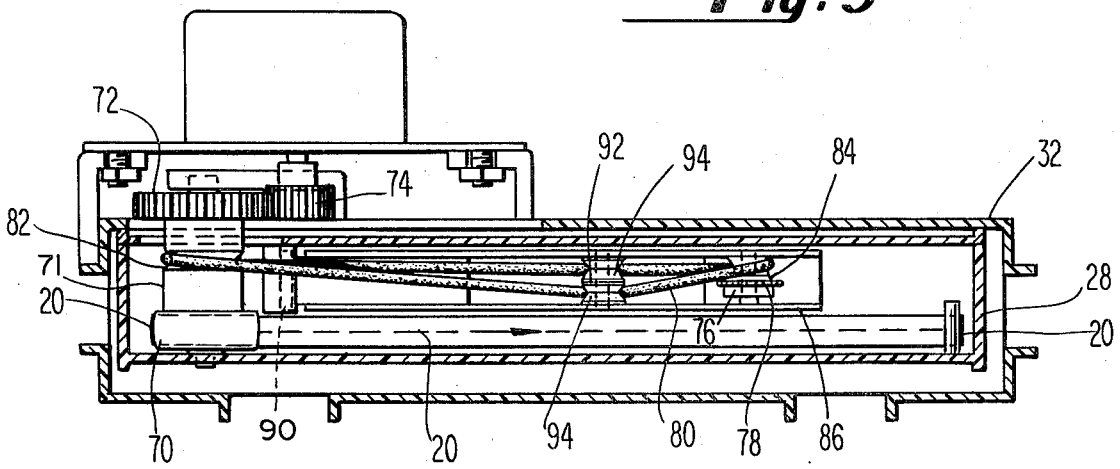
FIG. 4 is a sectional view of the cartridge taken along line 4—4 of FIG. 3.

As shown in FIGS. 3 and 4, the metering drive means comprises a friction drive wheel 70 which is covered with rubber or another suitable material capable of providing sufficient friction so as to pull the ribbon 20 from the supply reel 60. As shown in FIGS. 4 and 6, the wheel 70 mounted on a shaft 71 is driven through a gear train comprising a gear 72 mounted on the same shaft 71 with the wheel 70 and a gear 74 which engages the gear 72. The gear 74 is suitably driven so as to continuously rotate the wheel 70 as the carriage 22 and the movable print point move.

Figure 5:
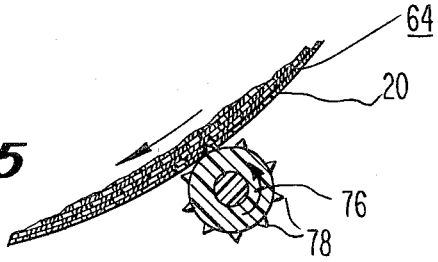
FIG. 5 is an enlarged sectional view of the ribbon take-up drive.

The take-up drive means as shown in FIGS. 4 and 5 comprises a wheel 76 which includes a plurality of circumferentially spaced spikes 78. The wheel 76 is mounted so as to be juxtaposed to the take-up reel 64 and permit the spikes 78 to penetrate the ribbon 20. In order to provide a tight packing of the ribbon 20 on the take-up reel 64, the spikes 78 have sufficient length to actually penetrate through the first layer of the ribbon 20 and into the second layer of the ribbon 20 on the take-up reel 64. Since the diameter of the outer layer on the take-up reel 64 is greater than the diameter of the interior or second layer on the take-up reel 64, a mechanical advantage is provided which assures that the ribbon 20 may be as tightly packed on the take-up reel 64 as it is originally packed on the supply reel 60.

In further accordance with the invention of the aforesaid application Ser. No. 833,269, the take-up drive means provided by the spiked wheel 76 tends to be overdriven with respect to the metering drive means provided by the friction wheel 70. This is accomplished by driving the take-up drive means wheel 76 with a belt 80 which is coupled to the shaft 71 on which the wheel 70 is mounted. As shown in FIG. 4, the diameter of the groove 82 in the shaft 71 which is engaged by the belt 80 is substantially larger than the diameter of the groove 84 in the wheel 76 which is engaged by the belt 80. As a consequence, there is a substantial mechanical advantage and the wheel 76 tends to be driven with respect to the wheel 70. However, the overdriving condition is limited by slippage between belt 80 and the grooves 82 and 84 of the shaft 71 and the wheel 76. It will therefore be understood that the belt 80 serves in effect, as a clutch, associated with the take-up drive of the wheel 76.

In accordance with another important aspect of the invention of the aforesaid application Ser. No. 833,269, the take-up drive wheel 76 is mounted on an arm 86 which is pivotally attached to a wall 88 of the cartridge 28 at a pin 90. The arm 86 is biased upwardly against the take-up reel 64 regardless of the amount of ribbon 20 stored on the take-up reel 64 by means of the tension on the belt 80. The arm 86 also carries an idler pulley 92 which includes a pair of side-by-side grooves 94 which are engaged by the belt 80. The pulley 92 holds the belt 80 away from the supply reel 60.

In accordance with the invention of the aforesaid application Ser. No. 833,269, a dynamic brake is associated with the supply reel 60. As shown in FIGS. 3 and 6 the brake comprises a brake arm 95 which pivots about a point 96. A tension spring 97 at the point 96 biases a braking surface comprising a cellular foam pad 99 against the outermost layer of the ribbon 20 on the reel 60 so as to control the tension on the ribbon 20 from the reel 60 to the friction wheel 70 even though the inertia of the supply reel 60 tends to continue rotation of the reel 60 causing slippage between the outer layer of the ribbon 20 in contact with the pad 99 and the inner layers of the reel 60. In order to limit rotation of the reel 60 under these circumstances, a second friction pad 104 is provided in the wall 105 of the cartridge 28 which contacts the edge of the ribbon 20 on the supply reel 60 as shown in FIGS. 3 and 6.

As shown in FIG. 3, the cartridge 28 also includes a number of other idlers and ribbon guides. In the path from the metering drive wheel 70 to the outlet 66, corner pin guides 98 are provided which space the ribbon 20 outwardly away from the arm 86 as well as the accumulated ribbon 20 on the take-up and supply reels 64 and 60. In addition, an idler pulley 100 is provided in this path adjacent the outlet 66 so as to rotate the ribbon 20 90° for alignment with the bracket mounting 38 and the leader 34.

In the path to the take-up reel 64, a guide pin 102 adjacent the inlet 68 rotates the ribbon 20 90°.

Figure 10:
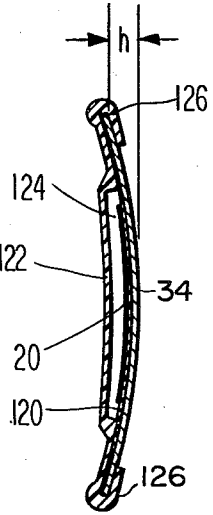
FIG. 10 is a sectional view of the flexible leader and ribbon of FIG. 9 taken along section line 10—10.
Figure 14:
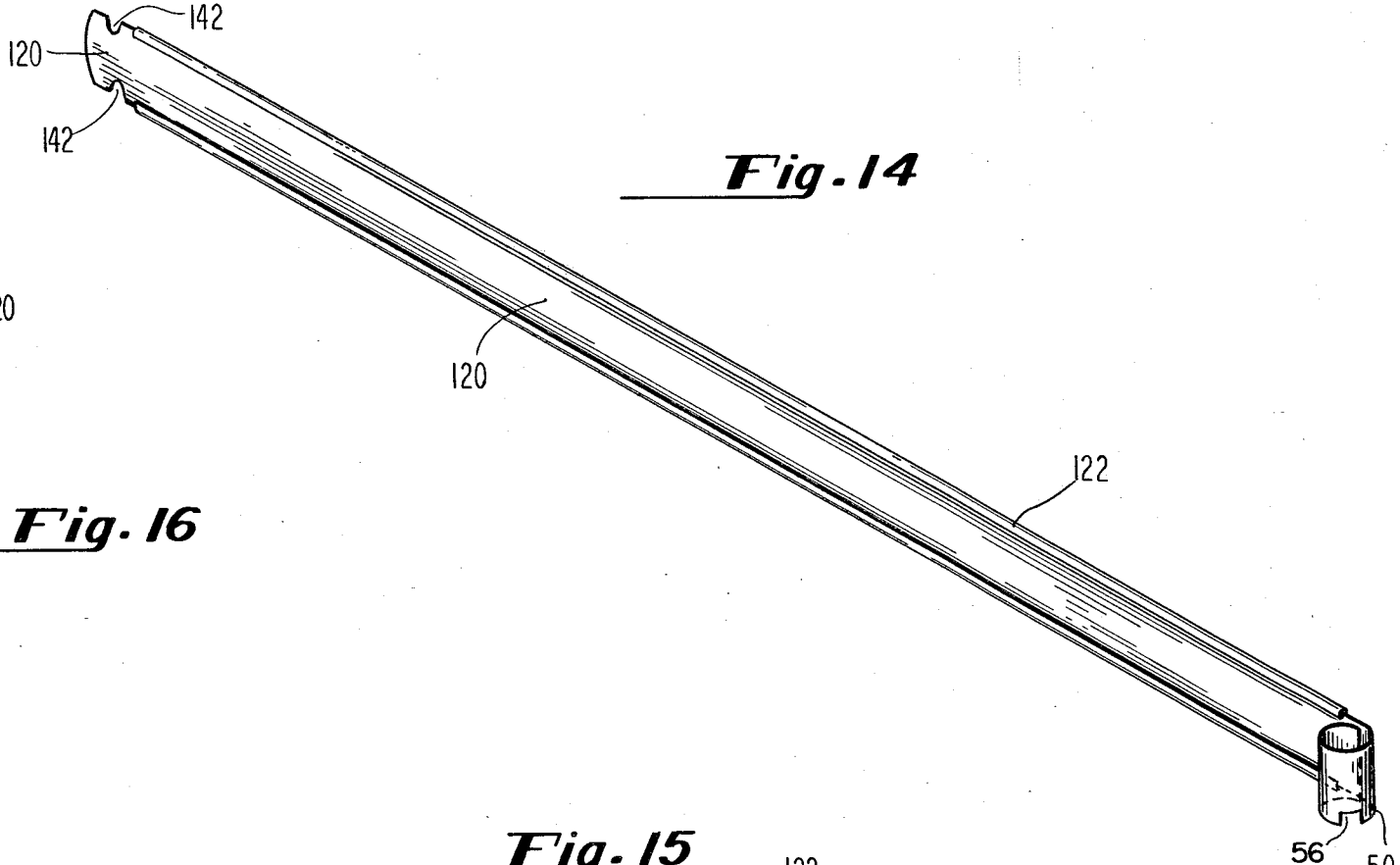
FIG. 14 is a perspective view of one side of the flexible leader with the leader in the straight, uncurved condition.
Figure 15:
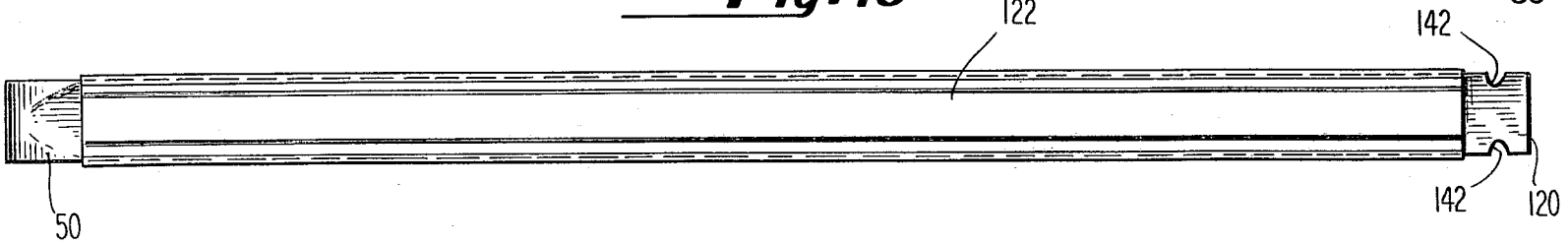
FIG. 15 is an elevational view of the other side of the flexible leader with the leader in the straight, uncurved condition.
Figure 16:
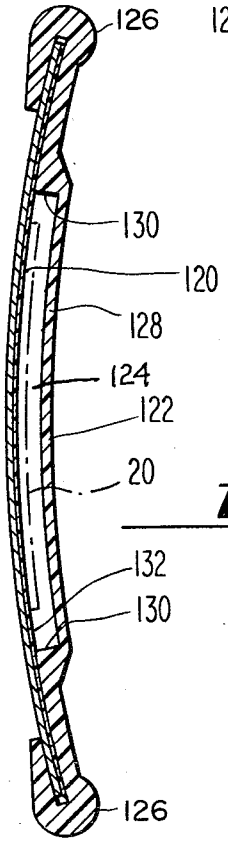
FIG. 16 is an enlarged view of FIG. 10.

In accordance with this invention, the flexible leaders 34 and 36 shown in FIGS. 10, 14 and 16 comprise a steel portion 120 resembling a carpenter's rule and having a radius of curvature transverse to or across the length of the leaders 34 and 36. A cover 122 cooperates with the steel portion 120 so as to form a channel 124 which receives the ribbon 20. As best shown in FIG. 16, the cover 122 comprises a channel base 128 and channel walls 130 with the extremities of the walls 130 which are spaced from the base 128 contacting the steel portion 120. The ends 126 of the cover 122 wrap around the edges of the steel portion 120 so as to secure the cover 122 to the steel portion 120 which is covered with a coating 132. The crossed curved steel portion 120 achieves two important functions.

First, the steel portion 120 serves to maintain a curvature in a single direction, i.e., there are no reverse bends or curves in the leaders 34 and 36. It will be understood that this is particularly important in order to prevent the inked surface of the ribbon 20 which is juxtaposed to the plastic member or cover 122 from coming into contact with the plastic member or cover 122.

Second, the cross curved steel portion 120 serves to maintain a substantially constant radius of curvature for the flexible leaders 34 and 36. This allows the flexible leaders 34 and 36 to assume the various positions shown in FIGS. 11 and 12 without having the flexible leaders 34 and 36 extend into a position of interference with the various portions of the printing apparatus. Note that the curvature in each of leaders 34 and 36 essentially travels along the leaders 34 and 36 as the carriage 22 moves while the radius remains constant.

In order for the cross curved steel portion 120 to serve this function, it is necessary that the cover 122 be permitted to slide on the cross curved steel portion 120. By creating this sliding relationship between the cover 122 and the steel portion 120, the steel portion 120 is capable of assuming two beam heights without interference by the cover 122. A first beam height h which is shown in FIG. 10 is assumed when the leader 34 is substantially straight. A second and lesser beam height is assumed when the leader 34 or 36 has a curvature shown in FIGS. 11 and 12. Note that the transverse curvature is convex with respect to the traveling center of curvature of the leaders 34 and 36.

In order to assure that the ribbon 20 remains spaced from the cover 122, the leaders 34 and 36 must maintain a curvature which is concave with respect to the print point. This requires that the steel portion 120 of the leaders 34 and 36 be positioned on the inside of the curvature with the uninked side 21 of the ribbon 20 in contact with the side of the steel portion 120 facing away from the center c such that the uninked side 21 faces generally outwardly away from the print point at the print point and the inked side 65 of the ribbon 20 spaced from the cover 122 faces generally toward the print point at the print point.

Figure 7:
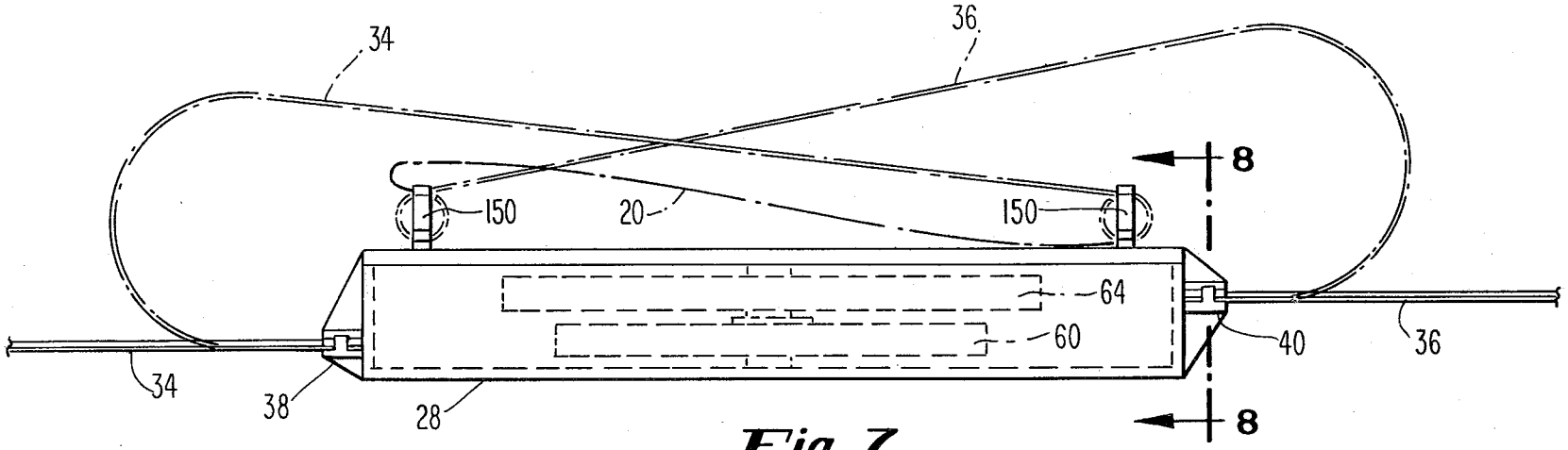
FIG. 7 is an end view of the cartridge showing the ribbon and flexible leaders in the stowed position.
Figure 9:
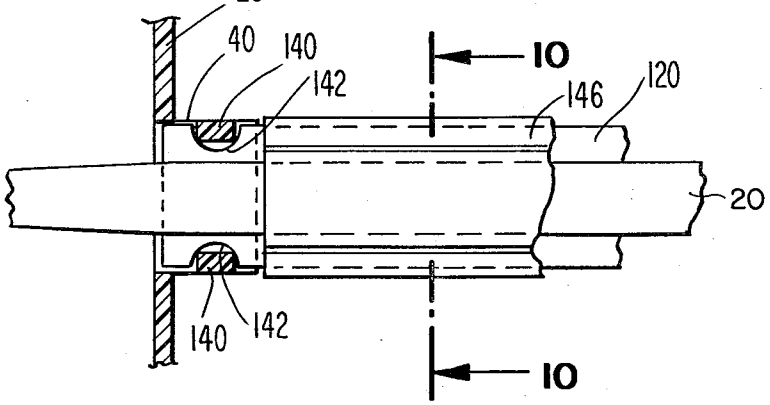
FIG. 9 is a sectional view of a portion of the cartridge shown in FIG. 8 taken along line 9—9.
Figure 8:
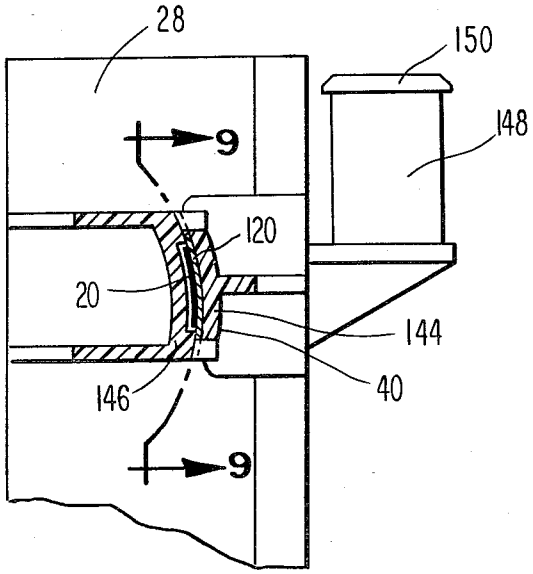
FIG. 8 is a sectional view of the cartridge shown in FIG. 7 taken along line 8—8.

Referring now to FIGS. 7–9, it will be seen that the leaders 34 and 36 are attached to the cartridge 28 by the brackets 38 and 40 which include projections 140 which are inserted into slots or recesses 142 of the steel portion 120 in the leaders 34 and 36. The plastic cover 122 may then extend up to the bracket 40 or the bracket 38. As shown in FIG. 8, the bracket 40 comprises two portions 144 and 146 which tend to sandwich the leader 36 in place with the keying projection 140 properly located with respect to the recesses 142. As also shown in FIG. 8, the cartridge 28 includes stowing posts 148 which are adapted to receive the loops 50 and 52 when the leaders 34 and 36 are in the stowed position. The posts 148 include heads 150 which connect the loops 50 and 52 to the case of the cartridge 28 when the leaders 34 and 36 are stowed as shown in FIG. 7.

Referring again to FIG. 2, it will be seen that the cartridge 28 with the leaders 34 and 36 in the stowed position may be inserted into the pocket 30 of the integrally molded receptacle 32. Note further that the receptacle 32 includes integrally molded fingers 160 which are adapted to engage the walls 162 of the cartridge 28. Referring to FIG. 3, it will be seen that the fingers 160 are adapted to slide along the walls 162 of the cartridge 28. The bottom of the pocket 30 includes a projection 164 which is received by an opening 166 in the bottom of the cartridge 28 so as to properly locate the cartridge 28 within the receptacle 32.

Although a particular cartridge 28 has been shown and described, various modifications may be made in the cartridge 28 itself. For example, the supply reel 60 and the take-up reel 64 may be mounted on separate axes. Or in the alternative, the cartridge 28 may be of the stuffed type without utilizing reels of any kind.

It will therefore be understood that a preferred embodiment of the invention has been shown and described and various modifications may be made which fall within the true spirit and scope of the invention as set forth in the appended claims.

What is claimed is:

1. A printer comprising means for supporting a print receiving medium, laterally movable character printing means juxtaposed to said supporting means for establishing a laterally movable print point, a ribbon comprising a printing medium for advancing past said movable print point in printing relationship with said print receiving medium and said character printing means, stationary ribbon storage means for storing said ribbon, means for moving said ribbon between said print point and said storage means, the improvement comprising means for maintaining a substantially constant path length from said ribbon storage means to said print point including flexible leader means and flexible cover means extending across said leader means so as to form a channel for said ribbon to move therethrough for supporting said ribbon, said means for maintaining a substantially constant path length maintaining curvature in a single direction as said movable print point moves, said flexible cover means being slidable with respect to said flexible leader means.

2. The printer of claim 1 wherein said means for maintaining a substantially constant path length is characterized by curvature in a concave direction with respect to said print point such that said ribbon is in substantial contact with said flexible leader means and spaced from said flexible cover means.

3. The printer of claim 2 wherein said ribbon includes a first side in contact with said flexible leader means and a second side spaced from said cover means, said ribbon including ink on said second side.

4. The printer of claim 1 wherein said flexible leader means is characterized by a radius of curvature transverse to the length of said leader means in a substantially straight line segment of said leader means.

5. The printer of claim 4 wherein said transverse curvature is convex with respect to the center of curvature of said leader means.

6. The printer of claim 5 wherein said ribbon is in contact with said leader means on the side of said leader means facing away from said center of curvature of said leader means.

7. The printer of claim 1 wherein said ribbon includes an inked side facing generally away from the center of said curvature and an uninked side facing generally toward the center of said curvature and in contact with said leader means.

8. The printer of claim 6 wherein said leader means includes a steel portion.

9. The printer of claim 8 wherein said cover means may move relative to said leader means along the length thereof.

10. The printer of claim 9 wherein said cover means is slidable along the length of said leader means.

11. The printer of claim 10 wherein said cover means extends around the edges of said leader means for attaching said cover means to said leader means and is slidably fixed thereto.

12. The printer of claim 8 wherein said cover means comprises plastic attached to said steel portion.

13. The printer of claim 4 wherein said radius of transverse curvature is provided by said leader means being characterized by a first beam height when said leader means is substantially straight and a second beam height when said leader means is curved whereby the leader means is confined to a transverse curvature in said single direction as said print point moves.

14. The printer of claim 13 wherein said cover means is slidably attached to said leader means.

15. The printer of claim 13 wherein said leader means comprises a steel portion and said cover means is slidably attached thereto.

16. The printer of claim 15 wherein said cover means forms a channel including a channel base and channel walls, the extremities of said walls spaced from said base contacting the steel portion of said leader means.

17. The printer of claim 16 wherein said cover means also extends around the edges of said leader means for securing said cover means to said steel portion.

18. The printer of claim 1 including means for connecting a portion of said means for maintaining a substantially constant path length adjacent said print point to said storage means for stowing in a compact position.

19. A printer comprising means for supporting a print receiving medium, laterally movable character printing means juxtaposed to said supporting means for establishing a laterally movable print point, a ribbon comprising a printing medium for advancing past said movable print point in printing relationship with said print receiving medium and said character printing means, stationary ribbon storage means for storing said ribbon, means for moving said ribbon between said print point and said storage means, the improvement comprising means for maintaining a substantially constant path length from said ribbon storage means to said print point including steel flexible leader means extending from a point of attachment to said ribbon storage means for supporting said ribbon, said flexible leader means having a transverse curvature in a substantially straight line segment, means for mounting said flexible leader means for maintaining said transverse curvature at the point of attachment to said storage means so as to substantially restrict curvature of said flexible leader means to a single direction as said movable print point moves; and flexible cover means extending across said leader means so as to form a channel for said ribbon, said cover means extending substantially to said point of attachment to said ribbon storage means and said cover means is movable along the length of said leader means.

20. A cartridge for use with a printer comprising: ribbon storage means for storing ribbon and flexible leader means extending from a point of attachment to said ribbon storage means for guiding said ribbon between said storage means and a print point in said printer while maintaining a substantially constant path length from said ribbon storage means to said print point, said flexible leader means having a transverse curvature in a substantially straight line segment, the improvedment comprising means for maintaining the transverse curvature of said flexible leader means at the point of attachment to said storage means including shaping means having said transverse curvature for contacting said flexible leader means, said shaping means being carried on said storage means so as to substantially restrict curvature of said flexible leader means to a single direction as said print point moves.

21. The cartridge of claim 20 wherein said flexible leader means comprises steel.

22. The cartridge of claim 21 including flexible cover means extending across said flexible leader means so as to form a channel for said ribbon while still maintaining said transverse curvature of said flexible leader means.

23. The cartridge of claim 22 wherein said cover means extends substantially to said point of attachment.

24. The cartridge of claim 23 wherein said cover means is movable in the direction along the length of said leader means.

25. A printer comprising means for supporting a print receiving medium, laterally movable character printing means juxtaposed to said supporting means for establishing a laterally movable print point, a ribbon comprising a printing medium for advancing past said movable print point in printing relationship with said print receiving medium and said character printing means, stationary ribbon storage means for storing said ribbon, means for moving said ribbon between said print point and said storage means, the improvement comprising means for maintaining a substantially constant path length from said ribbon storage means to said print point including flexible leader means, said flexible leader means comprising a plastic cover means for forming a channel having a channel base and channel side wall for enclosing said ribbon as said ribbon moves along said leader means, said leader means further comprising means for preventing the reverse bending of said plastic cover means so as to prevent contact between said ribbon and said channel base; said means for preventing the reverse bending of said plastic cover means comprising a steel portion characterized by a first beam height when said leader means is substantially straight and a second beam height when said leader means is curved whereby curvature of said leader means is confined to a single direction of curvature whereby contact between said ribbon and said channel base may be avoided; and said plastic cover means is slidable along the length of said steel portion of said leader means.

26. A printer comprising means for supporting a print receiving medium, laterally movable character printing means juxtaposed to said supporting means for establishing a laterally movable print point, a ribbon comprising a printing medium for advancing past said movable print point to print in relationship with said print receiving medium and said character printing means, stationary ribbon storage means for storing said ribbon, means for moving said ribbon between said print point and said storage means, the improvement comprising:

means for maintaining a substantially constant path length from said ribbon storage means to said print point comprising flexible leader means including cover means extending across said leader means so as to form a channel, said leader means including said cover means maintaining curvature in a single direction as said movable print point moves; and means for maintaining tension on said ribbon so as to substantially prevent contact between said cover means and said ribbon;

said leader means comprising a steel portion characterized by a first beam height when said leader means is substantially straight and a second beam height when said leader means is curved whereby the curvature of said leader means is confined to a single direction as said print point moves; and said cover means is slidable with respect to said sfteel portion of said leader means.

27. Flexible leader means for conveying a ribbon to a print point, comprising a first steel support portion and a second plastic cover portion, said steel support portion comprising a band of steel constrained by means confining the opposing edges of said band at an end thereof to positions spaced apart from one another a distance less than the width of said band to define a substantially constant first radius of curvature transverse said edges when said steel support portion is substantially straight, said first radius of curvature defining a substantially constant second radius of curvature assumed by said steel support portion perpendicular to said first radius, and said plastic cover portion extending between the edges of said steel band and permitting the flexure of said steel band between a first configuration in which said band is curved perpendicular to its edges, said curvature being defined by said first radius and assumed by said steel support portion when said flexible leader means is substantially straight, and a second configuration, in which said steel band is substantially flat perpendicular to its edges, assumed when said band is curved in a single direction perpendicular to said edges.

28. The leader means of claim 27 wherein said plastic cover portion is slidable along the length of said steel support portion.

* * * * *